US008228284B2

(12) United States Patent
Furry et al.

(10) Patent No.: US 8,228,284 B2
(45) Date of Patent: Jul. 24, 2012

(54) LIGHTING APPARATUS INCLUDING LEDS AND PROGRAMMABLE CONTROLLER FOR CONTROLLING THE SAME

(75) Inventors: Kevin Furry, Folsom, CA (US); Charles Somerville, Folsom, CA (US); Eric Peak, Sacramento, CA (US)

(73) Assignee: L.E.D. Effects, Inc., Rancho Cordova, CA (US)

( * ) Notice: Subject to any disclaimer, the term of this patent is extended or adjusted under 35 U.S.C. 154(b) by 1475 days.

(21) Appl. No.: 11/627,652

(22) Filed: Jan. 26, 2007

(65) Prior Publication Data

US 2008/0180269 A1 Jul. 31, 2008

(51) Int. Cl.
*G09G 3/36* (2006.01)

(52) U.S. Cl. ..... 345/102; 345/212; 345/214; 345/204; 345/82

(58) Field of Classification Search ..... 315/247, 315/291, 292, 224, 225, 209 R, 307–326, 315/185 S; 345/212, 214, 211, 204, 207, 345/690, 82, 90, 91, 102, 104
See application file for complete search history.

(56) References Cited

U.S. PATENT DOCUMENTS

| | | | | |
|---|---|---|---|---|
| 6,016,038 | A | 1/2000 | Mueller et al. | |
| 6,150,774 | A | 11/2000 | Mueller et al. | |
| 6,292,901 | B1 | 9/2001 | Lys et al. | |
| 6,777,891 | B2 | 8/2004 | Lys et al. | |
| 7,075,505 | B2 * | 7/2006 | Sakaguchi et al. | 345/87 |
| 7,148,632 | B2 * | 12/2006 | Berman et al. | 315/189 |
| 7,173,383 | B2 * | 2/2007 | Vornsand et al. | 315/291 |
| 7,511,437 | B2 * | 3/2009 | Lys et al. | 315/307 |
| 2003/0057886 | A1 | 3/2003 | Lys et al. | |

OTHER PUBLICATIONS

PCT International Search Report for PCT/US2007/088498; International Filing Date: Dec. 21, 2007; International Publication No.: WO 2008/094366 A3; International Publication Date: Aug. 7, 2008; Date of Mailing May 22, 2008; 2 pgs.

* cited by examiner

*Primary Examiner* — Tuyet Thi Vo
(74) *Attorney, Agent, or Firm* — Cantor Colburn LLP

(57) ABSTRACT

The present invention describes a lighting apparatus which includes a regulator configured to receive power, LEDs of at least two different colors, and a programmable controller. The programmable controller includes software that is configured to provide a digital pulse width signal to the LEDs in response to a data signal. Also included is according to an embodiment of the present invention is a programmable controller with non-volatile memory for storing the software, which may be upgradeable.

31 Claims, 7 Drawing Sheets

Data Signal (OxFF, ID, RR, GG, BB, OxFF, ID, RR, GG, BB..)

| | |
|---|---|
| START: | Initialize processor, communication ports and IO pins.<br>Start timer interrupt |
| COM LOOP: | Read byte from input data port.<br>If byte == OxFF. Then goto DOPACKET<br>Send byte to output data port<br>Goto COM LOOP |
| DOPACKET: | Read byte from input data port.<br>If byte == ID of this dot. Then goto GETDATA<br>Send OxFF to output data port<br>Send byte to output data port<br>Goto COM LOOP |
| GET DATA: | Read RR byte from input data port and store in memory<br>Read GG byte from input data port and store in memory<br>Read BB byte from input data port and store in memory<br>Goto COM LOOP |
| TIMER: | Use RR,GG,BB memory values and store into pulse width timer to produce output pulse widths on Red, Blue, Green, output pins of CPU. |

FIG. 3

| QTY | TITLE | DETAIL | REFMEMO | MFR | MFR P/N |
|---|---|---|---|---|---|
| 1 | CAP, SMT, POL, TANT, EIA SIZE A (3216) | 1 UF, 25V, 10% | C3 | KEMET | T491A105K025AS |
| 1 | RESISITOR, SMT, 1/10W, 5%, 0805 | 120 OHM | R3 | PANASONIC | ERJ-6GEYJ121V |
| 1 | CAP, SMT, NONPOL, CERAMIC, X7R, 0805 | 0.1 UF, 100V, 10% | C1 | TDK | C2012X7R2A104K |
| 2 | CONN, 2.5MM, HEADER, RA | 4 POS | P7, P8 | JST | S4B-EH |
| 2 | RESISTOR, SMT, 1/10W, 5% 0805 | 82 OHM | R1, R2 | PANASONIC | ERJ-6GEYJ820 |
| 1 | CAP, SMT, TANTALUM, 3216, ROHS | 3.3UF, 10V | C2 | KEMET | T491A335K010AT |
| 1 | LED, SMT, PLCC6 | RGB, NICHIA | LED1 | NICHIA | NSSM016A |
| 1 | PCB, BLANK | COOL DOT TEST CELL | | | |
| 0 | FIRMWARE, CPU, PSOC CY8C24123A | COOL DOT TEST CELL,-522 | | | |
| 0 | ASSEMBLY INSTRUCTIONS | COOL DOT TEST CELL | | | |
| 1 | IC, CPU, PSOC, 4DB, SOIC8, 4K | CY8C24123A | U1 | CYPRESS | CY8C24123A |
| 1 | IC,REGULATOR,SMT,SOT23-5,ROHS,LDO | 5V, 100MA, LP2891 | U2 | SEMICONDUCTOR | 5.0/NOPB |

FIG. 6

LIGHTING APPARATUS INCLUDING LEDS AND PROGRAMMABLE CONTROLLER FOR CONTROLLING THE SAME

CROSS-REFERENCE TO RELATED APPLICATIONS

None.

BACKGROUND OF THE INVENTION

Light emitting diodes (LEDs) have a broad range of uses in various applications. On one end of the spectrum, LEDs are used in keychain flashlights, while on the other end of the spectrum, LEDs are used in conjunction with digital control technology in complex computer lighting networks.

The primary colors red, green and blue (RGB) can be combined in different proportions to generate almost any color in the visible spectrum. As a consequence, it is commonly known that combining the projected light from at least two LEDs of different primary colors can produce lighting with selectable colors.

In some computer lighting networks, data signals are processed using integrated circuit (IC) controllers such as the systems described in U.S. Pat. Nos. 6,150,774 and 6,016,038 by Mueller et al., both of which are hereby incorporated by reference. Use of IC technology for data processing is not without its drawbacks, however. IC controllers do not offer much in the way of flexibility because IC technology cannot be easily updated, changed, or improved once a lighting network has been put in place without considerable expense. In fact, in order to change the functionality of a computer lighting network it is often necessary to completely replace many if not all IC controller elements.

Large computer lighting networks present several challenges. Particularly large computer lighting networks that have been installed for some period of time require maintenance. Performing maintenance on such lighting networks presents special challenges when LEDs are used in certain applications such as being used as "pixels" in a video wall when it becomes necessary to replace one or more LED pixels that have burned out or have otherwise failed. It will be appreciated by one of skill in the art that replacement of an LED module solves one problem while creating another. As LEDs age, their brightness can change. Thus, installing a new LED pixel into an area that is surrounded by older LEDs with reduced brightness results in uneven brightness of LED pixels.

Uneven pixel brightness is real problem in many large computer controlled lighting networks, such as when LEDs are used as pixels in a video wall covering a large area such as the side of a building. Even if outright pixel failure doesn't prematurely occur, the LED pixels will eventually start to produce different levels of brightness or color over time, creating a splotchy effect.

Once installed, it is not possible to periodically perform calibration of LED brightness for individual LEDs without replacing the IC controllers used to process data. It will be appreciated by one of skill in the art that replacement of IC components is both expensive and inconvenient. In a large computer lighting network, replacement of IC components may not even be feasible.

Accordingly, it would desirable to be able to control the brightness levels for individual LEDs without incurring the expense or hassle of replacing integrated circuit processors.

SUMMARY OF THE INVENTION

The foregoing needs are met, to a great extent, by the present invention, wherein in one aspect an apparatus is provided that in some embodiments will offer control over brightness levels of individual LEDs to aid in calibration of illumination networks. There is also provided in the practice of the invention, a lighting apparatus capable of being updated with new or different features without incurring the burden and/or undue expense associated with replacing hardware controller modules.

In accordance with one embodiment of the present invention, a lighting apparatus is provided which includes a regulator configured to receive power, LEDs of at least two different colors, and a programable controller. The programable controller includes software that is configured to provide a digital pulse width signal to the LEDs in response to a data signal. Additionally, another embodiment includes a housing that substantially encloses the components of the lighting apparatus. Another embodiment of the present invention provides a programmable controller with non-volatile memory for storing the controller software. In some embodiments, the software is upgradeable.

In accordance with yet another embodiment of the present invention, a lighting apparatus is provided that includes a regulator configured to receive power, multiple LEDs of at least two different colors. The apparatus also includes an input configured to accept a data signal that includes color illumination information that is associated with an addressable controller. For color illumination information that is addressed to the controller a programmable processor provides a digital pulse width signal to the multiple LEDs.

In accordance with still another embodiment of the present invention, a lighting apparatus is provided that includes a first conductor configured to receive a data signal, a second conductor configured to receive power, two or more LEDs, and an addressable controller. In this embodiment, the addressable controller is connected to the first and second conductors. The addressable controller also includes a programmable processor which is configured to provide a digital pulse width signal to the two or more LEDs in response to the data signal.

In accordance with still yet another embodiment of the present invention, a lighting apparatus is provided that includes an input configured to receive a data signal wherein the data signal includes one or more RGB packets. This embodiment also includes a regulator configured to receive power, a plurality of LEDs of at least two different colors, and a programmable controller. In this embodiment, the programmable controller is connected to the regulator and configured to process the data signal and to provide a digital pulse width signal to the plurality of LEDs in response to one or more RGB packets in the data signal.

Certain embodiments of the invention are outlined above in order that the detailed description thereof may be better understood, and in order that the present contributions to the art may be better appreciated. There are, of course, additional embodiments of the invention that will be described below and which will form the subject matter of the claims appended hereto.

In this respect, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE SEVERAL VIEWS OF THE DRAWING

Further features of the present invention will become apparent to those skilled in the art to which the present invention relates from reading the following description with reference to the accompanying drawings, in which:

FIG. 3 shows pseudo code of data operations performed by an embodiment of the programmable controller of the present invention.

FIG. 6 is an exemplary list of parts that may be used to construct an embodiment of the lighting apparatus of the present invention.

DETAILED DESCRIPTION OF THE INVENTION

Figure 1:
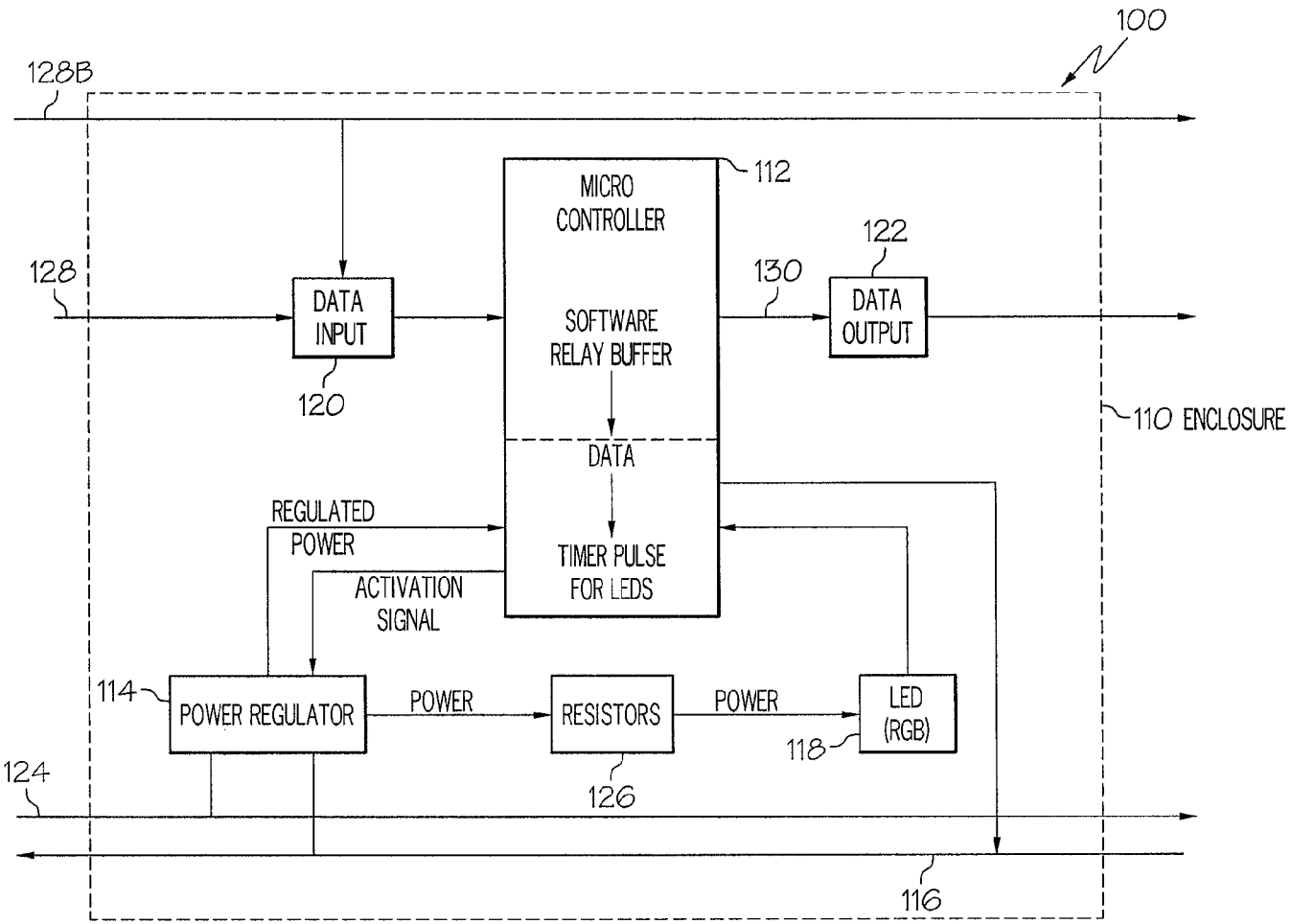
FIG. 1 is a block diagram of an embodiment of the lighting apparatus of the present invention.

The invention will now be described with reference to the drawing figures, in which like reference numerals refer to like parts throughout. An embodiment in accordance with the present invention provides a lighting apparatus which includes a regulator configured to receive power, LEDs of at least two different colors, and a programmable controller with software that is configured to provide a digital pulse width signal to the LEDs in response to a data signal. The above description is of an embodiment of the present invention and as such, is not intended to suggest any limitation in the scope of using or functionality of the invention.

Turning to FIG. 1, shown is a block diagram of an embodiment of the lighting apparatus of the present invention. Lighting apparatus 100 is self-contained, and is configured to be interchangeable with a similarly constructed lighting apparatus. Lighting apparatus 100 features an enclosure 110 which houses components including a controller 112. Controller 112 is connected to a power regulator 114, a common potential reference 116, and to LEDs 118. Controller 112 is further connected to a data input 120 and a data output 122. Power regulator 114 is connected to a power source 124, common potential reference 116, and is in connection LEDs 118 via resistors 126.

Controller 112 is preferably a programmable microcontroller such as part number CY8C24x23A available from Cypress Semiconductor Corporation, San Jose, Calif. The teachings of the CY8C24x23A datasheet are incorporated herein by reference. In some embodiments programmable controller includes configurable blocks of analog and digital logic, programmable interconnects to a fast CPU, Flash program memory, SRAM data memory, and configurable I/O. Controller 112 includes upgradeable software with instructions for the controller processor.

Regulator 114 serves several functions which include providing power to controller 112, providing a 5V voltage reference through resistor 126 to the LEDs 118, and reducing voltage from any voltage above 5V to 5V. Resistor 126 is schematically shown; however, it will be appreciated by one of skill in the art that there may be a separate resistor for each LED individually, or as a group of LEDs having colors. An exemplary regulator is number LP2981IM5-5.0/NOPB by National Semiconductor Corporation of Santa Clara, Calif. The teachings of the LP2981IM5-5.0/NOPB data sheet are hereby incorporated by reference.

LEDs 118 may include individual red, blue, and green LEDs such as those available from Nichia America Corporation. Some embodiments of the present invention may include single LEDs containing multiple color-emitting semiconductor dies such as part number NSSM016A available from Nichia America Corporation. The teachings of the NSSM016A datasheet are incorporated herein by reference. It will be appreciated by one of skill in the art that the LEDs are primary colors which may be used to generate any color in the spectrum using combinations of pre-selected proportions thereof. In practice, use of three primary colored LEDs is preferable, though it will be readily understood by one of skill in the art that any lighting source of primary colors can be combined to product any color in the spectrum.

Multiple lighting apparatuses 100 can be configured to operate using several types of communication including serial, parallel, or some combination thereof. Data signal 128 is used when multiple lighting apparatuses 100 are in operation in a serial communication configuration. Data signal 128B is used when multiple lighting apparatuses 100 are in operation in a parallel communication configuration. Except as expressly noted herein, the operation of the lighting apparatus 100 is substantially similar when configured for serial (data signal 128) or parallel (data signal 128B) communications. FIG. 1 shows data input 120 configured to receive data signals 128/128B.

A number of different technologies may be used to provide the data signal 128/128B including the DMX 512, and standard serial protocols. Data signal 128/128B includes packet data corresponding to red, green and blue intensity. Controller 112 produces pulse width enable for each of the color LEDs 118 corresponding to the color illumination data. It should be noted that data input 120 may also be configured to receive data signal 128B when in a parallel communication mode in which multiple lighting apparatuses 100 receive data signal 128B simultaneously.

It will be noted by one of skill in the art that use and implementation of pulse width modulation (PWM) for assisting in the control of electrical devices is well known in the art and is described in U.S. Pat. No. 3,989,992 to Robert H. Schmidt which is hereby incorporated by reference. Controller 112 includes upgradeable software with instructions for the controller processor to process the data signal 128 and provide a digital pulse width signal which is directed to the LEDs 118.

In some embodiments of the present invention, lighting apparatus 100 includes RGB LEDs 118 and a smart controller 112 chip encapsulated into a weatherproof enclosure 110. The smart controller chip provides ample processing power to produce smooth color transitions, thus making the lighting apparatus of the present invention a suitable candidate for video walls.

One function of lighting apparatus 100 is for controller 112 to accept a data signal 128/128B via data input 120. Data signal 128/128B is processed by the controller 112 CPU to make red, green, and blue color timing pulses. These pulses are sent to red/green/blue LEDs 118. In a serial data configuration using data signal 128, the controller 112 CPU sends unused color data to the data output 122. In a parallel configuration using data signal 128B, unused color data is simply discarded. Controller 112 software can be changed for any application, therefore changing the function of the lighting apparatus 100. It will also be appreciated that controller 112 software can be configured to switch from serial data signal 128 to parallel data signal 128B or vice versa. Controller 112 software may also be configured to prioritize operation in either parallel or serial communications modes depending on the presence or absence of a particular parameter or data signal type. Thus, controller 112 software may be configured to operate in parallel communications mode even if data input 120 receives data signal 128.

Figure 2:
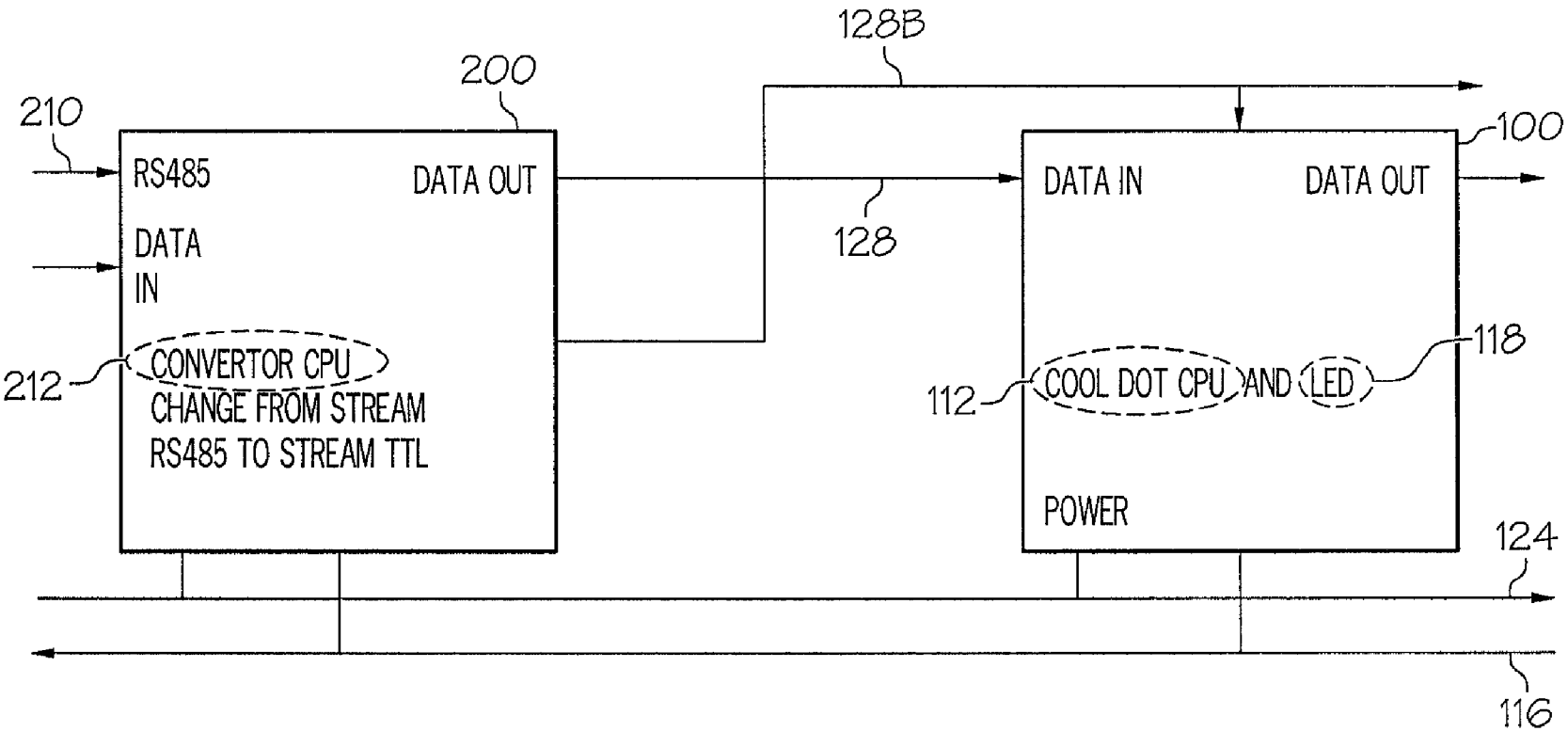
FIG. 2 illustrates a schematic of an embodiment of the lighting apparatus of the present invention in communication with a protocol converter.

FIG. 2 is a block diagram of an embodiment of the lighting apparatus 100 of the present invention in communication with a protocol converter 200. A computer (not shown) will process images into data that is sent over a network 210 to protocol converter 200. Protocol converter 200 includes a micro controller 212 that may be of similar design to the controller 112 used in the lighting apparatus 100.

Examples of data signal protocols include DMX512 and serial protocol. DMX 512 is a standard digital lighting protocol used by the entertainment industry and known to those skilled in the art. The DMX protocol is described in a United States Theatre Technology, Inc. publication entitled "DMX512/1990 Digital Data Transmission Standard for Dimmers and Controllers," incorporated herein by reference. The DMX512 technology is also an older technology that relies on expensive, specialized hardware and wiring to communicate between a computer and the lighting fixtures.

Use of serial protocol provides similar functionality to the DMX512 protocol using standard, off-the-shelf hardware and traditional computer networking equipment for communication. Serial protocol is a relatively simple, addressed, packet based, serial protocol capable of controlling millions of LEDs and running real-time streaming video at movie frame rates or higher.

Protocol converter 200 provides the data signal 128/128B for the lighting apparatus 100. The data signal 128/128B includes data packets corresponding to red, green and blue (RGB) color intensity. The protocol of the data signal 128/128B may include a standard serial format such as: packet header_ID, and RGB illumination information. In the lighting apparatus 100, in response to data signal 128/128B, controller 112 produces pulse width signals for each color LEDs 118 that correspond to the RGB illumination information in the data signal 128/128B.

FIG. 3 shows pseudo code of data operations performed by an embodiment of the programmable controller of the present invention. The program flow has been simplified, however, one of skill in the art could duplicate the functionality of FIG. 3. (For simplicity, details of the operation of the controller with respect to data packets such as headers and stop bits are omitted from this description, and will be well appreciated by those of skill in the art.)

An advantage of the present invention is the use of updatable software on the controller which effectively converts the controller processor into a dedicated hardware device to drive LEDs.

Figure 4A:
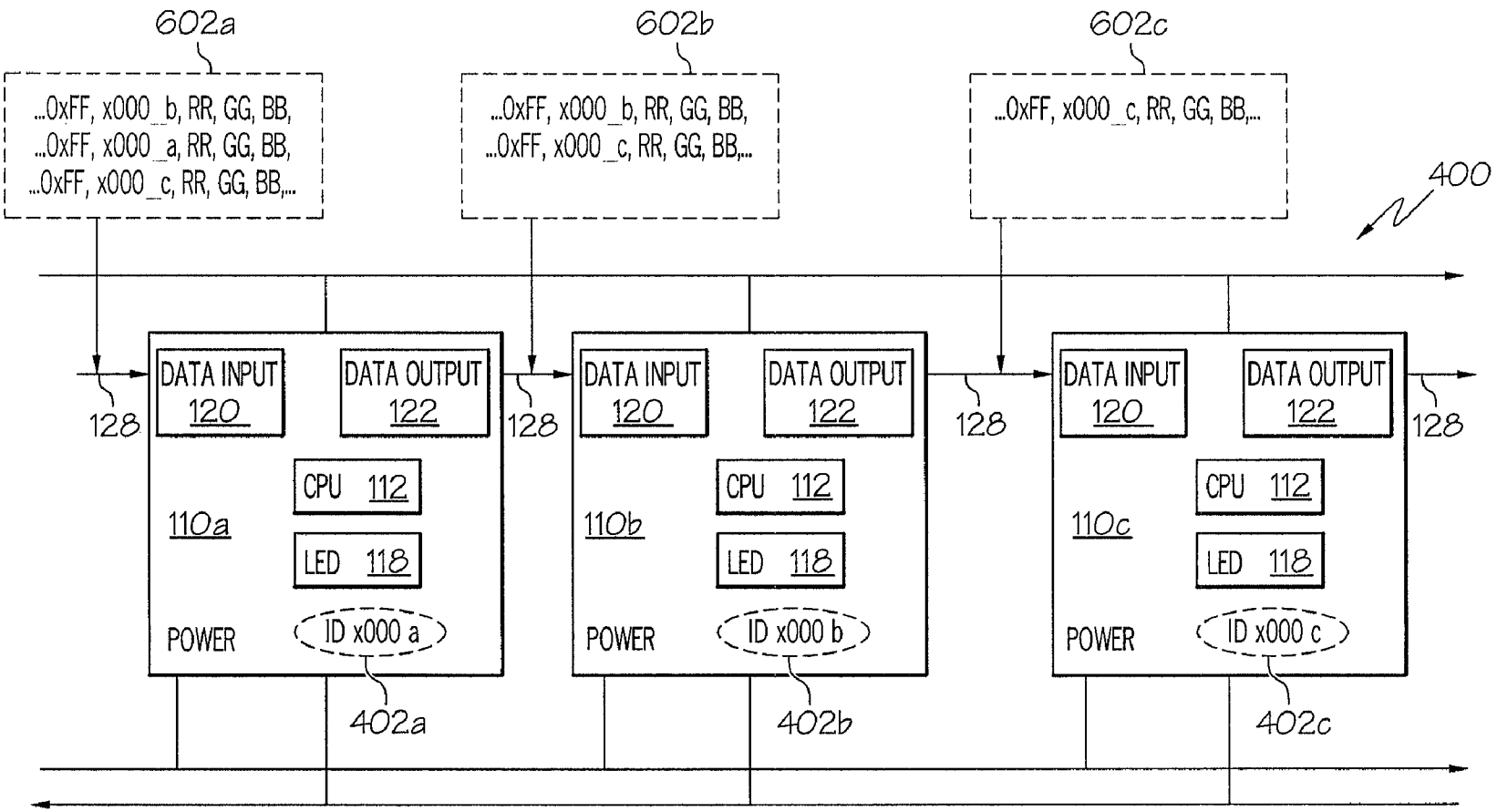
FIG. 4A is a block diagram showing a series of serially connected lighting apparatuses according to an embodiment of the present invention.

FIG. 4A is a block diagram showing a series of serially connected lighting apparatuses 110*a*, 110*b*, 110*c* according to an embodiment of the present invention. As shown, each lighting apparatus 110*a*, 110*b*, 110*c* has an apparatus id 402*a*, 402*b*, 402*c*. The apparatus id 402*a*, enables each lighting apparatus 110*a* in a computer lighting network to be individually addressable. Individual addressability permits a granular level of control for individual lighting apparatus 110*a* in a computer lighting network. It will also be appreciated by one of skill in the art that lighting apparatus 110*a* may be connected into a string or other network arrangement to additional lighting apparatuses.

In operation, data signal 128 is sent to data input 120 of the first lighting apparatus 110*a*. Controller 112 receives the data signal 128 from data input 120. Controller 112 processes data signal 128 and removes RGB color data/illumination information that is addressed to the apparatus id 402*a* of the first lighting apparatus 110*a*. The data signal 128 and remaining RGB color data 602*b* is sent to the next lighting apparatus 110*b* via the data output 122 of the first lighting apparatus 110*a*. This sequence continues down the string until there is no more lighting apparatuses, or until there is no more data.

Figure 4B:
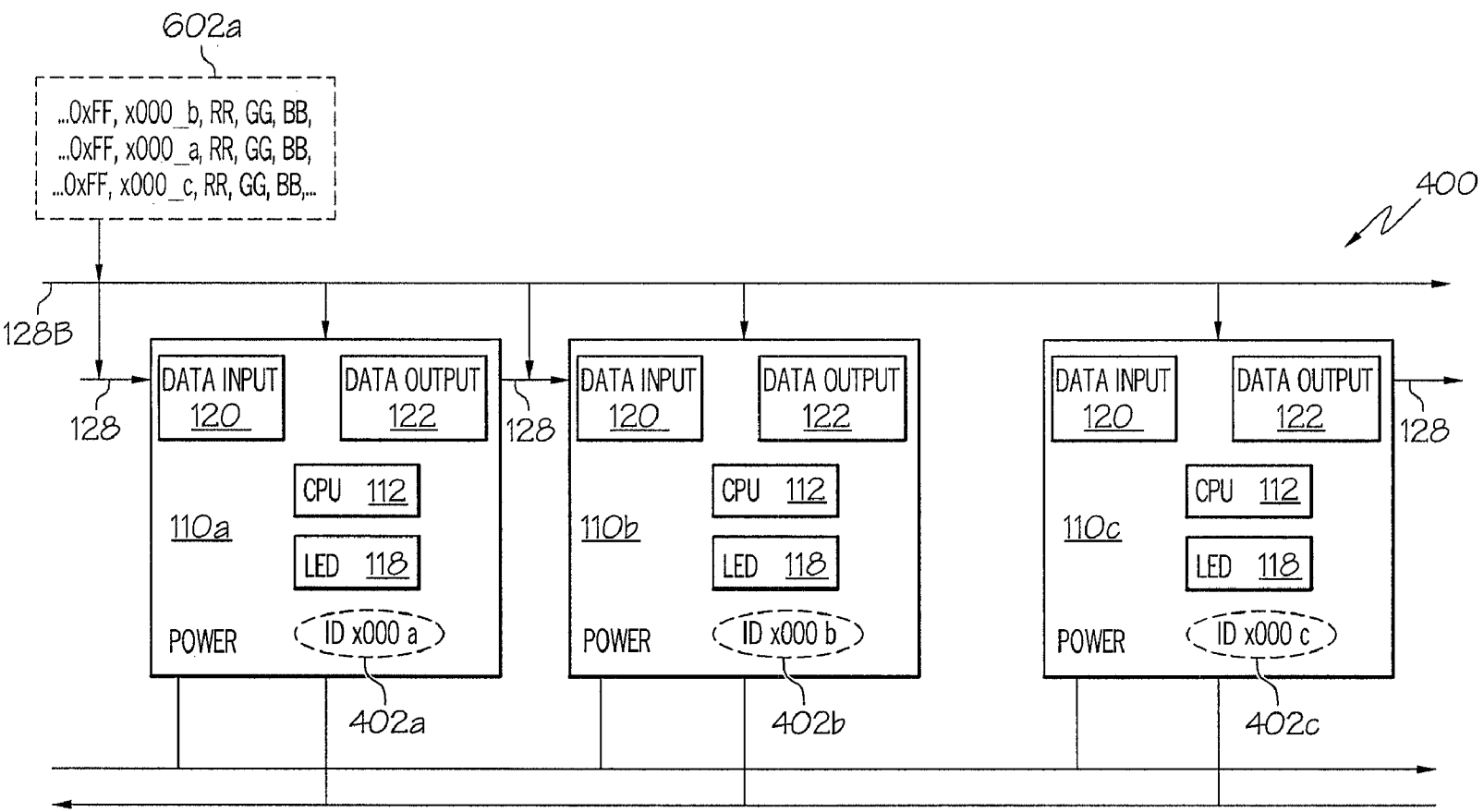
FIG. 4B is a block diagram showing a series of parallel connected lighting apparatuses according to an embodiment of the present invention.

FIG. 4B is a block diagram showing a series of parallel connected lighting apparatuses 110*a*, 110*b*, 110*c* according to an embodiment of the present invention. In operation, data signal 128B is sent simultaneously to the data input 120 of all connected lighting apparatuses 110*a*, 110*b*, 110*c* with all RGB color data 602*a*. Controller 112 receives the data signal 128B from data input 120. Controller 112 processes data signal 128B to listen for RGB color data/illumination information that is addressed to the apparatus id 402*a* of the first lighting apparatus 110*a*. In this arrangement, RGB information that is not addressed to the apparatus id 402*a* of the first lighting apparatus 102*a* is discarded. As shown in FIG. 4B, data signal 128B and RGB color data 602*a* is sent simultaneously to all lighting apparatuses 110*a*, 110*b*, 110*c*.

Figure 5:
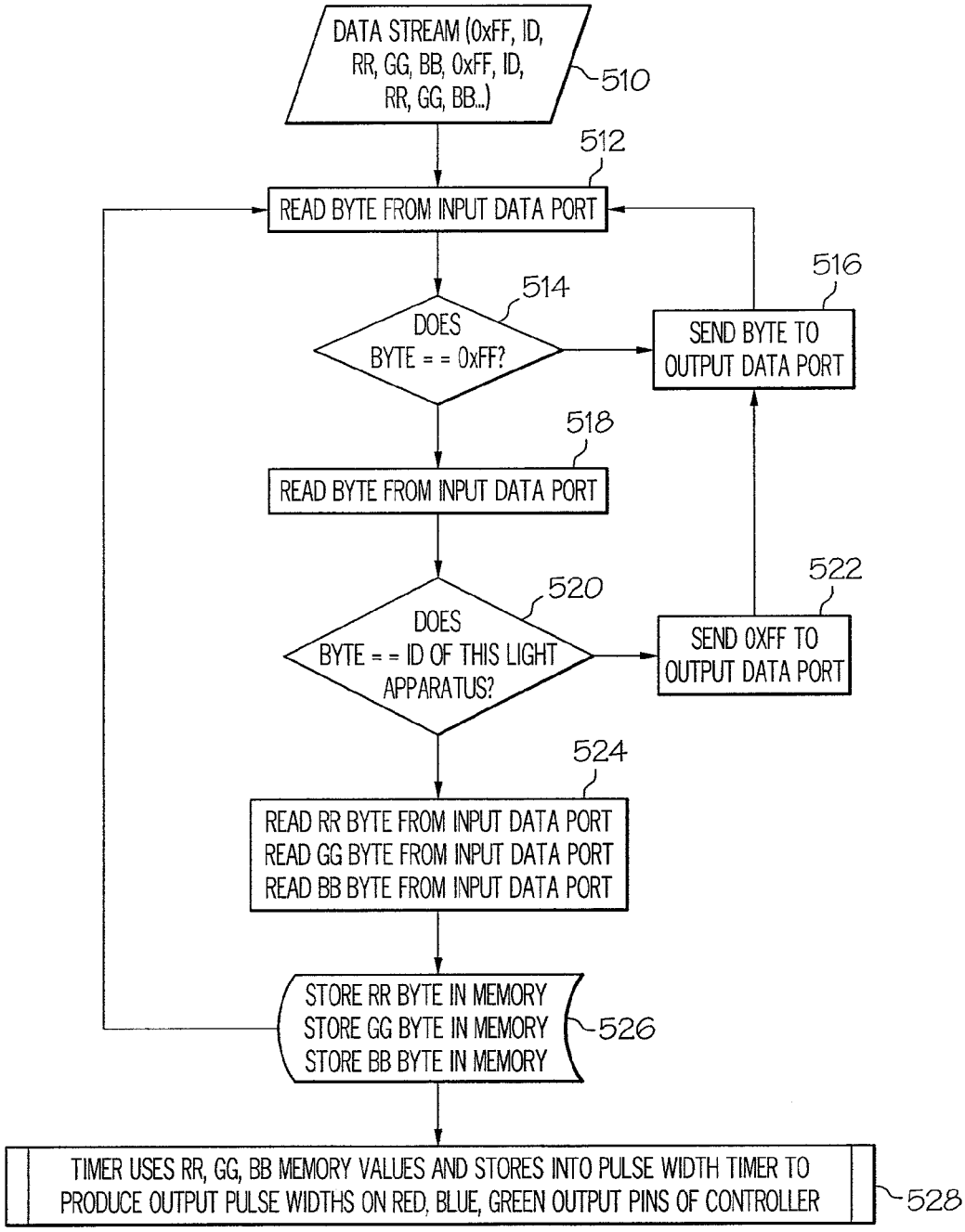
FIG. 5 is a flow chart illustrating steps that may be performed by a lighting apparatus in accordance with an embodiment of the present invention.
Figure 5:
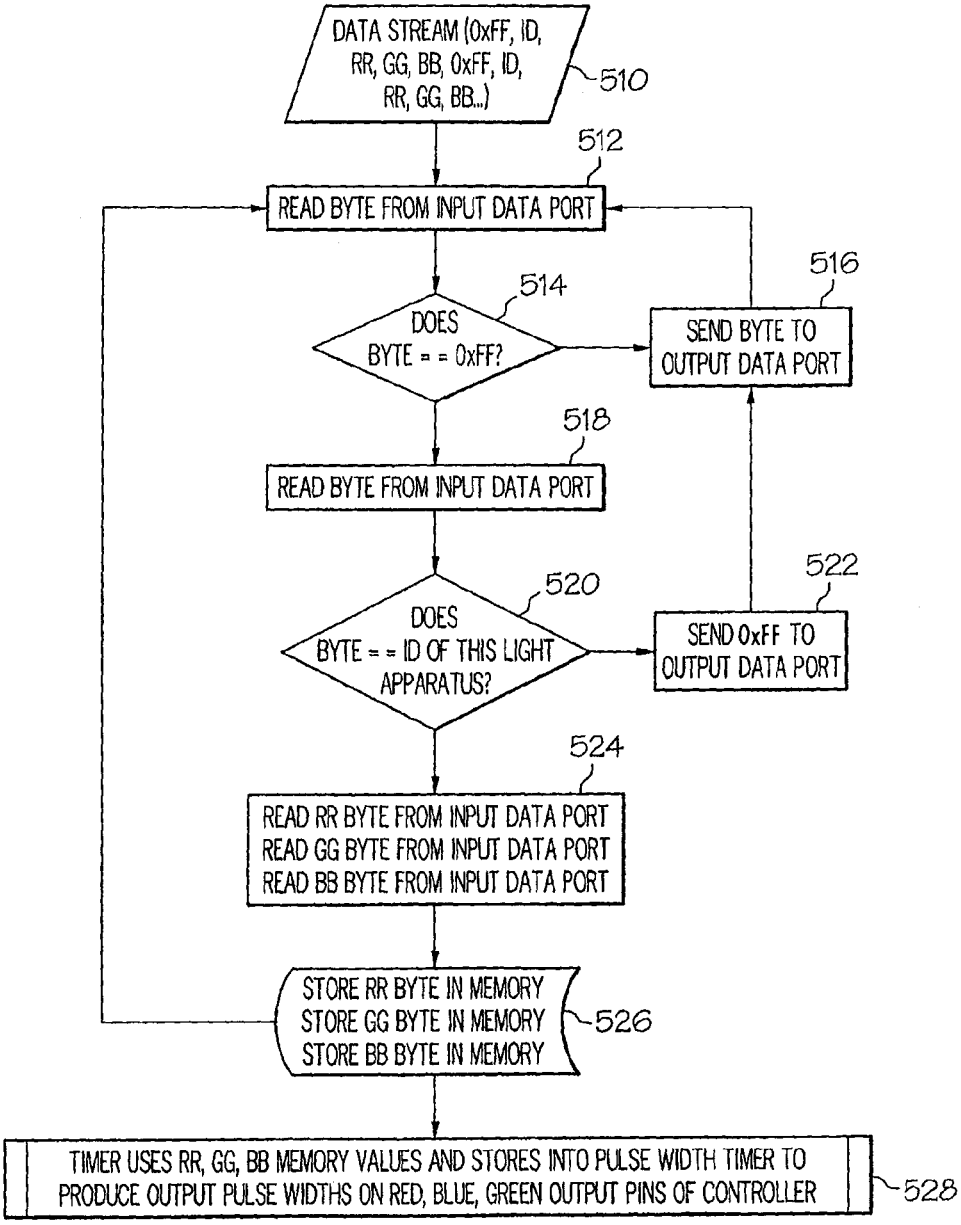

FIG. 5 is a flow chart illustrating steps performed by a lighting apparatus in accordance with an embodiment of the present invention. Item 510 represents an exemplary data signal including one or more packets of RGB color data/illumination information. As shown in item 510, each packet in the data signal is individually addressed to a particular lighting apparatus/controller via including an apparatus ID in each packet.

In step 512, a byte of data is read from the input data port of the lighting apparatus. In step 514, the byte read in step 512 is checked for a packet header. If the byte of data does not have a packet header, step 516 is performed and the byte is sent to the output data port of the lighting apparatus. Following step 516, step 512 is performed again as described above.

Step 518 is performed if the byte of data includes a packet header. In step 518, a byte of data is read from the input data port of the lighting apparatus. Step 520 checks if the byte of data is addressed to the individual lighting apparatus that is performing the check. If the apparatus ID of the byte of data does not match address of the individual lighting apparatus that is performing the check, then step 522 is performed. In step 522, a packet header is sent to the output data port and steps 516 and 512 are performed as described above.

Step 524 is performed if the apparatus ID of the byte of data matches the address of the lighting apparatus that is performing step 520. In step 524, RR, GG, BB bytes are read from the input data port and step 526 stores the RR, GG, BB bytes into memory. After step 526, step 512 is performed again as described above. Additionally, step 528 is performed in which the lighting apparatus controller uses the RR, GG, BB values stored in memory in step 526 produces output pulse widths on Red, Green, and Blue output pins of the controller.

FIG. 6 is an exemplary list of parts that may be used to construct an embodiment of the lighting apparatus of the present invention. It should be noted that the present invention may include additional parts that are not shown, substitute parts, or less than all of the parts that are shown. In no event will the present invention be limited to the exemplary parts set forth in FIG. 6.

One of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

We claim:

1. A lighting apparatus comprising:

a regulator configured to receive power;

a plurality of LEDs of at least two different colors adapted to be coupled to said regulator and a common potential reference; and a programmable controller connected to said regulator, wherein said programmable controller comprises software configured to provide digital timing pulses to said plurality of LEDs in response to receiving a data signal including one or more color data packets comprising color information relating to more than one color.

2. The lighting apparatus of claim 1 further comprising a housing that substantially encloses said regulator, said plurality of LEDs, and said programmable controller.

3. The lighting apparatus of claim 1 wherein said programmable controller further comprises a non-volatile memory for storing said software.

4. The lighting apparatus of claim 1, wherein said software is upgradeable.

5. The lighting apparatus of claim 1 further comprising an output configured to send said data signal to a second lighting apparatus.

6. The lighting apparatus of claim 1 wherein said software is upgradeable to adjust one or more output parameters for said plurality of LEDs.

7. The lighting apparatus of claim 1, wherein the one or more color data packets include RGB packets.

8. The lighting apparatus of claim 1 wherein said programmable controller is addressable and wherein said software is configured to process said data signal to provide a digital pulse width signal to said plurality of LEDs in response to color illumination information of the one or more color data packets that is addressed to said programmable controller.

9. The lighting apparatus of claim 8 wherein said software is further configured to remove said color illumination information addressed to said programmable controller prior to sending said data signal to a second lighting apparatus.

10. A lighting apparatus comprising:

a regulator configured to receive power;

a plurality of LEDs of at least two different colors adapted to be connected to said regulator and to a common potential reference;

an input configured to receive a data signal wherein said data signal includes one or more RGB packets; and an addressable controller configured to be coupled to said regulator and said input wherein said controller comprises a programmable processor comprising software configured to process said data signal to provide a digital pulse width signal to said plurality of LEDs in response to the one or more RGB packets.

11. The lighting apparatus of claim 10 further comprising a housing that substantially encloses said regulator, said plurality of LEDs, said input, and said addressable controller.

12. The lighting apparatus of claim 10 wherein said addressable controller further comprises a memory store.

13. The lighting apparatus of claim 10 wherein said software is upgradeable to adjust one or more output parameters for said plurality of LEDs.

14. The lighting apparatus of claim 10 wherein said addressable controller further comprises a non-volatile memory store comprising software with programmable processor instructions.

15. The lighting apparatus of claim 14 wherein said software is upgradeable.

16. The lighting apparatus of claim 15 wherein said addressable controller further comprises and output wherein said output is configured to send said data signal to a second lighting apparatus.

17. A lighting apparatus comprising:

data input means for receiving a data signal including one or more RGB packets;

power input means for receiving power;

two or more LED means; and controller means connected to said data input means and said power input means wherein said controller means includes processing means with instructions configured to provide timing pulse to said two or more LED means in response to said one or more RGB packets.

18. The lighting apparatus of claim 17 wherein said two or more LED means comprise different colors.

19. The lighting apparatus of claim 17 further comprising housing means wherein said housing means substantially encloses said two or more LED means, and said controller means.

20. The lighting apparatus of claim 17 wherein said data input means is further configured for sending said data signal.

21. The lighting apparatus of claim 17 wherein said controller means further comprises memory means for storing said instructions.

22. The lighting apparatus of claim 17 wherein said controller means further comprises memory means for storing said instructions wherein said instructions are upgradeable.

23. The lighting apparatus of claim 22 wherein said instructions are software instructions.

24. A lighting apparatus comprising:

an input configured to receive a data signal comprising one or more RGB packets;

a regulator configured to receive power;

a plurality of LEDs of at least two different colors connected to a common potential reference and adapted to receive power from said regulator; and a programmable controller, wherein said programmable controller is connected to said regulator and said programmable controller includes software instructions configured to process said data signal to provide a digital pulse width signal to said plurality of LEDs in response to said one or more RGB packets.

25. The lighting apparatus of claim 24 wherein said programmable controller further comprises non-volatile memory for storing said software instructions.

26. The lighting apparatus of claim 25 wherein said software instructions are upgradeable.

27. The lighting apparatus of claim 24 wherein said instructions are upgradeable to adjust one or more output parameters of said plurality of LEDs.

28. A lighting apparatus comprising:

a plurality of lighting apparatuses, each lighting apparatus being individually addressable and comprising:

an input configured to receive a data signal including one or more color data packets comprising color information relating to more than one color;

an output configured to output the data signal;

a plurality of LEDs comprising at least two different colors; and a controller configured to process the data signal and remove the one or more color data packets that is addressed to a respective lighting apparatus.

29. The lighting apparatus of claim 28, wherein when the plurality of lighting apparatuses are connected in series, the controller of a first lighting apparatus of the plurality of lighting apparatuses removes the one or more color data packets addressed to the first lighting apparatus and the data signal and remaining color data packets are sent to a next lighting apparatus of the plurality of lighting apparatus in the series.

30. The lighting apparatus of claim 28, wherein when the plurality of lighting apparatuses are connected in parallel, the data signal is sent simultaneously to the inputs of each lighting apparatus of the plurality of lighting apparatuses, the controller of each lighting apparatus of the plurality of lighting apparatuses is configured to process the data signal for color data packets addressed to each respective lighting apparatus and to discard remaining color data packets.

31. The lighting apparatus of claim 28, wherein the one or more color data packets include RGB packets.

* * * * *

UNITED STATES PATENT AND TRADEMARK OFFICE

CERTIFICATE OF CORRECTION

PATENT NO. : 8,228,284 B2
APPLICATION NO. : 11/627652
DATED : July 24, 2012
INVENTOR(S) : Kevin Furry, Charles Somerville and Eric Peak It is certified that error appears in the above-identified patent and that said Letters Patent is hereby corrected as shown below:

In the Drawings:

Delete Drawing Sheet 6 of 7, and replace with Drawing Sheet 6 of 7. (Attached)

Delete Drawing Sheet 7 of 7, and replace with Drawing Sheet 7 of 7. (Attached)

In the Specifications:

In column 2, line 10, after “a” delete “programable” and insert -- programmable --, therefor.

In column 2, line 10, after “The” delete “programable” and insert -- programmable --, therefor.

In column 5, line 13, delete “packet header_ID,” and insert -- packet header, device_ID, --, therefor.

In the Claims:

In column 8, line 25, in Claim 16, delete “and” and insert -- an --, therefor.

Signed and Sealed this
Third Day of September, 2013

Teresa Stanek Rea
*Acting Director of the United States Patent and Trademark Office*

| QTY | TITLE | DETAIL | REFMEMO | MFR | MFR P/N |
|---|---|---|---|---|---|
| 1 | CAP, SMT, POL, TANT, EIA SIZE A (3216) | 1 UF, 25V, 10% | C3 | KEMET | T491A105K025AS |
| 1 | RESISTOR, SMT, 1/10W, 5%, 0805 | 120 OHM | R3 | PANASONIC | ERJ-6GEYJ121V |
| 1 | CAP, SMT, NONPOL, CERAMIC, X7R, 0805 | 0.1 UF, 100V, 10% | C1 | TDK | C2012X7R2A104K |
| 2 | CONN, 2.5MM, HEADER, RA | 4 POS | P7, P8 | JST | S4B-EH |
| 2 | RESISTOR, SMT, 1/10W, 5% 0805 | 82 OHM | R1, R2 | PANASONIC | ERJ-6GEYJ820 |
| 1 | CAP, SMT, TANTALUM, 3216, ROHS | 3.3UF, 10V | C2 | KEMET | T491A335K010AT |
| 1 | LED, SMT, PLCC6 | RGB, NICHIA | LED1 | NICHIA | NSSM016A |
| 1 | PCB, BLANK | COOL DOT TEST CELL | | | |
| 0 | FIRMWARE, CPU, PSOC CY8C24123A | COOL DOT TEST CELL,-522 | | | |
| 0 | ASSEMBLY INSTRUCTIONS | COOL DOT TEST CELL | | | |
| 1 | IC, CPU, PSOC, 4DB, SOIC8, 4K | CY8C24123A | U1 | CYPRESS | CY8C24123A |
| 1 | IC,REGULATOR,SMT,SOT23-5,ROHS,LDO | 5V, 100MA, LP2891 | U2 | SEMICONDUCTOR | 5.0/NOPB |

FIG. 6